US007331906B2

(12) United States Patent
He et al.

(10) Patent No.: US 7,331,906 B2
(45) Date of Patent: Feb. 19, 2008

(54) APPARATUS AND METHOD FOR REPETITIVE MOTION THERAPY

(75) Inventors: Jiping He, Tempe, AZ (US); Ryan B. Knight, Gainesville, FL (US)

(73) Assignee: Arizona Board of Regents, Tempe, AZ (US)

( * ) Notice: Subject to any disclaimer, the term of this patent is extended or adjusted under 35 U.S.C. 154(b) by 343 days.

(21) Appl. No.: 10/971,867

(22) Filed: Oct. 21, 2004

(65) Prior Publication Data

US 2005/0101448 A1 May 12, 2005

Related U.S. Application Data

(60) Provisional application No. 60/513,703, filed on Oct. 22, 2003.

(51) Int. Cl.
*A47D 13/04* (2006.01)

(52) U.S. Cl. ..... 482/69

(58) Field of Classification Search ..... 482/54, 482/69; 607/49; 601/18, 100, 103, 134
See application file for complete search history.

(56) References Cited

U.S. PATENT DOCUMENTS

| | | | | |
|---|---|---|---|---|
| 2,844,126 A | | 7/1958 | Gaylord | |
| 4,899,735 A | * | 2/1990 | Townsend et al. | 602/20 |
| 5,395,303 A | * | 3/1995 | Bonutti et al. | 602/16 |
| 6,666,798 B2 | * | 12/2003 | Borsheim | 482/54 |

OTHER PUBLICATIONS

Colombo et al., "Treadmill training of paraplegic patients using a robotic orthosis", J. Rehab. Res. Dev., 37(6):683-700, 2000.
Hannaford et al., "Actuator and movement control: Biological and technological models", J. Winters & S.L. Woo (Eds.), Multiple Muscle Systems: Biomechanics and Movement Organization pp. 101-120, New York: Springer-Verlag.
Hess et al., "A mechanized gait trainer for restoration of gait", J. Rehab. Res. Dev., 37(6):701-708, 2000.
Matjacic, Zlatko, "Robotics application in people with weak muscles—standing and walking", Institute for Rehabilitation, Republic of Slovenia, Zdrav Vestn 2004, 73:43-45.
Olsen, A.J., "Development of a robotic step training device for teaching individuals with neurologic impairments to walk", Advanced Technology Program, 2 pages, (Sep. 2001).

(Continued)

*Primary Examiner*—Lori Amerson
(74) *Attorney, Agent, or Firm*—Fulbright & Jaworski L.L.P.

(57) ABSTRACT

A repetitive motion therapy apparatus has a frame structure. An orthotic is adapted for securing to a part of a body. A pneumatic muscle is coupled between the frame structure and the orthotic for moving the orthotic. A control mechanism controls the pneumatic muscle. The pneumatic muscle contracts to impart movement to the orthotic. A winding spool and retractable cord is attached to the pneumatic muscle. The pneumatic muscle is operated by an electric mechanism, hydraulic mechanism, or spring mechanism to impart movement to the orthotic. The control mechanism has a variable airflow controller to control the movement of the orthotic. A feedback sensor is disposed on the body for providing data to the control mechanism. A treadmill imparts motion to the part of the body.

49 Claims, 5 Drawing Sheets

OTHER PUBLICATIONS

Reynolds, et al., "Modeling the dynamic characteristics of pneumatic muscle", Annals Biomed. Eng., 31:310-317, 2003.
Schulte, Jr., H.F., "The characteristics of the McKibben artificial muscle", Nat. Acad. Sci., Publication 874, pp. 94-115, 1961.
Tondu et al., "McKibben artificial muscle robot actuators", IEEE Control Systems, pp. 15-38, Apr. 2000.

* cited by examiner

APPARATUS AND METHOD FOR REPETITIVE MOTION THERAPY

CLAIM TO DOMESTIC PRIORITY

The present non-provisional patent application claims priority to provisional application Ser. No. 60/513,703 entitled "Pneumatic muscle-assistive gait-training device for use during treadmill rehabilitation with partial weight bearing support", filed on Oct. 22, 2003, by He et al.

FIELD OF THE INVENTION

The present invention relates in general to physical therapy equipment and, more particularly, to an apparatus and method for assistive repetitive motion therapy.

BACKGROUND OF THE INVENTION

Accidents, illnesses, diseases and strokes reduce people's ability to execute simple motor tasks, such as walking, reaching, and standing. The number of individuals with motor control deficiencies has grown rapidly in recent years. Improvements in health care, emergency response, and increased medical knowledge has led to a higher survival rate. With an increasing population of injured persons, the cost of rehabilitation, hospital stay, and medical expenses will continually increase each year. Billions are spent every year treating patients; costs are associated with medical care received. Such injuries are financially devastating to the victims and families; psychological, emotional, and financial distresses usually accompany such injuries. Not included in medical costs are lost productivity and reduced quality of life.

Although affected individuals may experience a return of some function (due to the plasticity of the nervous system or limited neural regeneration), intensive therapy is usually required to help restore lost motor function. A major deficit affecting a majority of patients is the inability to ambulate normally.

Over the years, scientists have obtained a better understanding of the underpinnings and mechanisms of human motor control. Various rehabilitative techniques and training methods have been experimented with. One of the first methods involved locomotion training in animal experimentation. Due to the success of locomotion training in animals, it was later tested on human subjects. Locomotion training further evolved to include treadmill training techniques. Expanding upon treadmill training, repetitive motion therapy was introduced to better train patients, and continues in widespread use today.

During the beginning phases of repetitive motion therapy, two or three physical therapists are often required to provide assistance. Two therapists either sit or kneel beside the patient and manually move the limbs through patterns resembling normal physiological movement. Depending on the partial weight bearing apparatus utilized, a third therapist may be required for hip stabilization. Due to the difficulty of the work, training sessions may be limited to the physical endurance of the therapists, rather than that of the patient. Generally, training sessions last for 30 minutes a day, 4 or 5 days a week. Sessions can be limited by the costs of employing multiple therapists each day over the course of the training time. Costs multiply with each additional patient. Although patients receive quality therapy, the lack of a standardized method leads to variability in training. Effective repetitive motion therapy relies on reproducible flexion and extension of the hips and knees, and also, loading and unloading of the lower limbs. Variability in the training of subject will lead to differences in flexion and extension and loading and unloading across subjects.

Limitations of manual training by physical therapists can be summarized as follows: (a) it is a strenuous task for therapists; (b) physiological movement patterns are non repeatable; (c) patient training time is limited by the endurance levels of therapists; and (d) treatment is expensive compounded over time.

Researchers have also experimented with various mechanical/robotic assistive devices. There are limitations associated with using these devices as well. The mechanical/robotic systems are also very expensive and complex. Moreover, the position control approaches used to drive extremities have only limited ability to adapt as the subject's ability to generate independent motions improves. Although these devices achieve their goals for producing repeatable motion training, they can be expensive, immobile, and require expert supervision during use of the device.

An uncomplicated device is needed to provide assistance to patients during repetitive motion therapy because current techniques are strenuous for physical therapists and expensive in employing multiple therapists. Also, existing mechanical devices can be expensive, complicated, and immobile. An assistive device is desired to help reduce costs associated with repetitive motion training and expand therapy to a greater number of patients.

A need exists for a simple, inexpensive, assistive device to alleviate the workload of physical therapists and to increase the availability of therapy.

SUMMARY OF THE INVENTION

In one embodiment, the repetitive motion therapy apparatus of the invention comprises a frame structure to support the apparatus, an orthotic which is adapted for securing to a part of a body, an adjustable linkage coupled between the frame structure and the orthotic for repeatedly moving the orthotic, and a control mechanism for controlling the adjustable linkage.

In another embodiment, the present invention is a method for providing repetitive motion therapy, which comprises securing an orthotic to a part of a body, wherein the orthotic is attached to an adjustable linkage, and actuating the adjustable linkage to cause repetitive motion of the orthotic which imparts corresponding movement of the portion of the body.

In another embodiment, the present invention is a method of making a therapy apparatus, which comprises providing a frame assembly, providing an orthotic adapted for securing to a portion of a body and providing an adjustable linkage for coupling between the frame assembly and the orthotic such that the adjustable linkage causes repetitive motion of the orthotic which imparts corresponding movement of the portion of the body.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Figure 1:
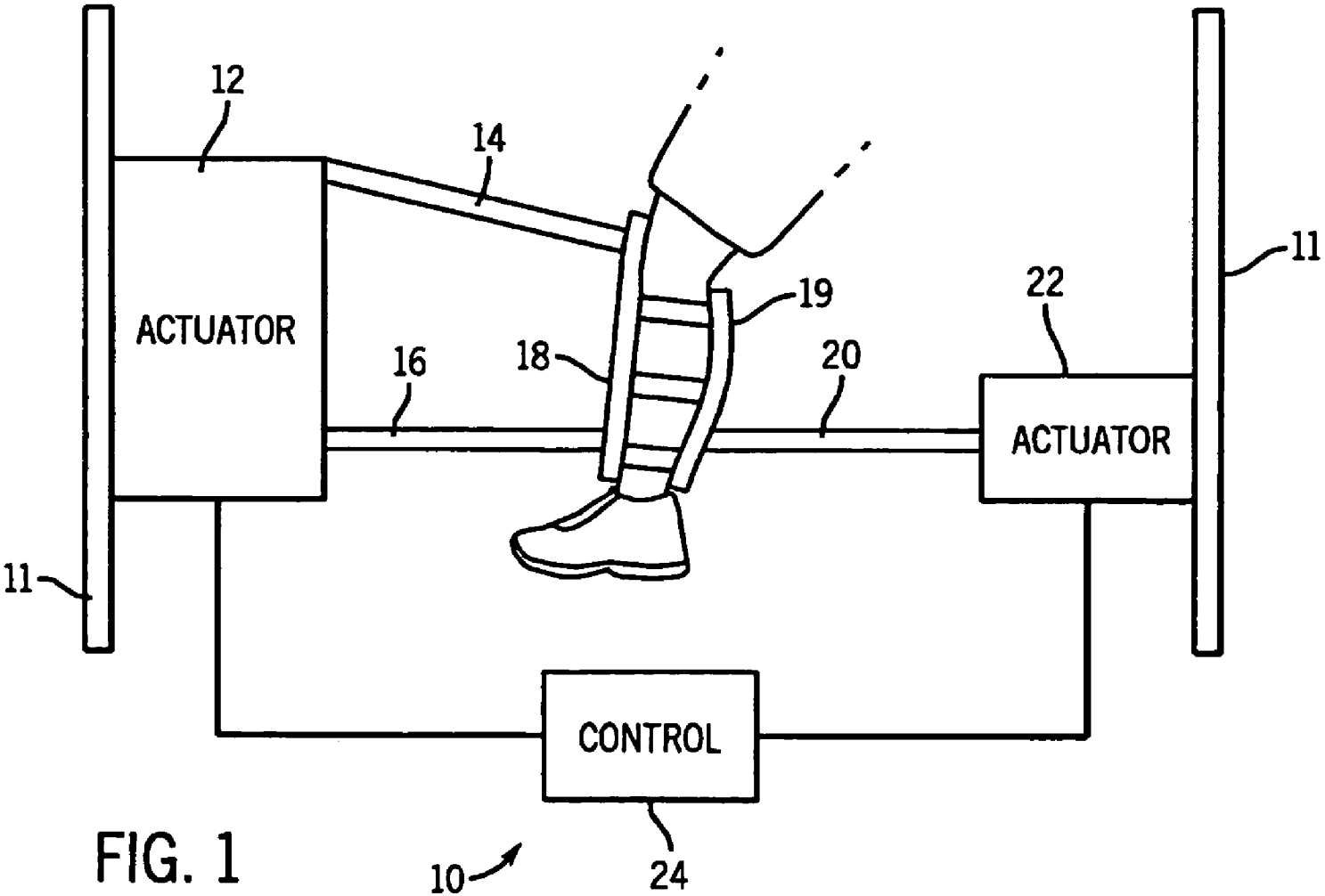
FIG. 1 illustrates simplified block diagram of the apparatus, including frame structures, adjustable linkages, actuators and a control mechanism.

FIG. 1 illustrates a simplified block diagram of the configuration of the repetitive motion therapy apparatus 10. Apparatus 10 has a frame structure 11 which provides structural support for various components of apparatus 10 as well as support for the weight of a body. Apparatus 10 also includes an actuator 12 which is coupled to frame structure 11. Actuator 12 is further coupled to adjustable linkages 14 and 16. Actuator 12 causes the repetitive movement of adjustable linkages 14 and 16. Actuator 12 can use a variety of mechanisms to move the adjustable linkages, including pneumatic, electrical, and hydraulic.

Adjustable linkages 14 and 16 are coupled to an orthotic 18. Adjustable linkages 14 and 16 are coupled between orthotic 18 and actuator 12 which is attached to frame structure 11. Orthotic 18 is adapted for securing to a part of a body. One embodiment may feature a hinged, segmented orthotic that allows relative motion among one or several segments. The repetitive movement of adjustable linkages 14 and 16 impart corresponding movement in orthotic 18, which in turn causes corresponding repetitive movement in a part of a body. Adjustable linkages 14 and 16 work to pull the part of the body forward or/and upward. Linkages 14 and 16 then relax to allow the part of the body to return to its previous state.

Actuator 22 is attached on the posterior side of a part of a body to frame structure 11. Actuator 22 is also coupled to an adjustable linkage 20. Adjustable linkage 20 is coupled between orthotic 19 and actuator 22 which is attached to frame structure 11. Orthotic 19 is also adapted for securing to a part of a body. Actuator 22 also causes repetitive movement of corresponding adjustable linkage 20. Again, actuator 22 can use a variety of mechanisms to move the adjustable linkages, including pneumatic, electrical, and hydraulic. The repetitive movement of adjustable linkage 20 imparts corresponding movement in orthotic 18, which causes corresponding repetitive movement in a part of a body. In this case, the posterior adjustable linkage 20 and actuator 22 work to pull the part of the body backwards after adjustable linkages 14 and 16 have relaxed.

A control mechanism 24 is attached to actuators 12 and 22 to control the actuators and in turn, the adjustable linkages. Control mechanism 24 can be made up of any number of systems to control the apparatus, such as mechanical and computer or microprocessor driven systems.

In a setting of repetitive motion therapy, linkages 14 and 16 work in tandem to bring the leg forward as controlled by actuator 12 and control mechanism 24. Linkages 14 and 16 then relax and actuator 22 as controlled by control mechanism 24 works to bring the leg backward. By repeating this motion, the patient is able to realize exercise of the muscle and stimulate recovery.

Figure 2:
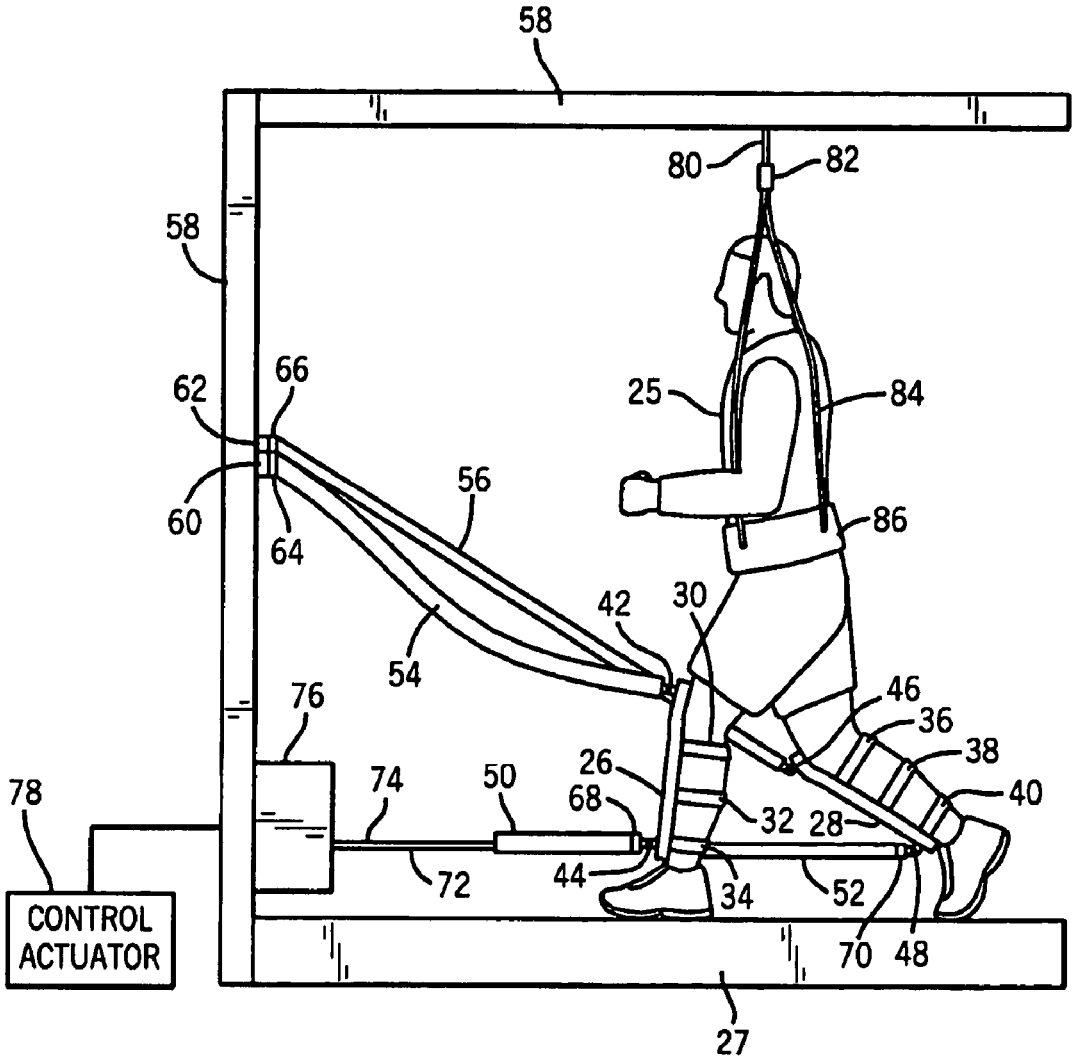
FIG. 2 illustrates a more detailed embodiment of the apparatus, including pneumatic muscles as adjustable linkages and utilization of a treadmill.

Turning to FIG. 2, a more detailed embodiment and working example of the apparatus is shown. A body 25 is shown as undergoing repetitive motion therapy on treadmill 27. The embodiment utilizes the posterior-directed motion of the treadmill to draw the legs backward, while the claimed apparatus is intended to assist in bringing the legs forward. The intent of the current embodiment is to move the lower legs in a similar manner to mimic physiological gait. The repetitive, gait-like pattern is intended to closely resemble the pattern of later stage, assisted, repetitive motion therapy performed by physical therapists using a treadmill.

Orthotics 26 and 28 have been adapted for securing to the patient's legs. Again, in one embodiment, orthotics 26 and 28 may be segmented or hinged to allow relative motion among two or more segments. Orthotics 26 and 28 are comprised of three layers of soft padding, three wide, soft Velcro straps, and a hard plastic covering from above the knee to ankle. Orthotic 26 is attached to the patient's left and right leg using Velcro straps 30, 32 and 34, respectively. Orthotic 28 is attached to the patient's right leg using Velcro straps 36, 38 and 40, respectively. Two attachment sites in each of orthotic 26 and 28 are seen for connecting adjustable linkages. A universal joint 42 is attached to orthotic 26 at approximately just above the knee joint axis of rotation. Additionally, a universal joint 44 is attached to orthotic 26 at approximately the ankle joint axis of rotation. Similarly, universal joint 46 is attached to orthotic 28 at approximately just above the knee joint axis of rotation, and universal joint 48 is attached to orthotic 28 at approximately the ankle joint axis of rotation.

In one embodiment of the repetitive motion therapy apparatus, pneumatic muscles are used as adjustable linkages 50, 52, 54 and 56. Pneumatic muscles are generally made up of an outer helical, braided mesh and an inner rubber bladder. As air is introduced into the bladder, the expansion creates pressure on the braided mesh. By virtue of the helix mesh the radial pressure is translated to an axial force. The braided mesh twists and causes the artificial muscle to contract. As air fills the pneumatic muscles the mesh angle eventually reaches a maximum and correlates to a maximum amount of contraction.

Pneumatic muscles are attractive for use in the apparatus because of their high force to weight and high work to mass ratio, their similarity to skeletal muscle, their cost efficient production and ease of control.

Natural compliance of the pneumatic muscle is appealing because the result is an inherent safety characteristic. Because pneumatic muscle is relatively easy to control and can be constructed with relatively inexpensive materials, design and construction costs of the apparatus may be minimized. Because pneumatic muscle has a high force to weight and high work to mass ratio, an embodiment comprising pneumatic muscles is lighter and smaller; the embodiment can be used in a variety of settings including the home as a result.

Pneumatic muscles allow a great deal of flexibility in adjusting the range of motion imparted to a part of the body undergoing therapy. A combination of air pressure adjustment, in conjunction with the amount of resistance supplied by the patient and equipment determine the proper range of motion. Such parameters as air pressure can be easily controlled and tailored to the individual patient.

In the present embodiment, four pneumatic muscles are sufficient to reproduce the gait pattern. Specifically, a single pneumatic muscle works to flex the hip and another pneumatic muscle extends the knee on each side of the patient. During the cyclic motion of treadmill walking, the lower limbs move in a posterior direction from heel strike to toe off due to the treadmill rotation. As the leg progresses through the stance phase, the knee is generally extended with only the hip angle changing. Therefore, the pneumatic muscles are responsible for generating the changes in the joint angles (hip and knee) from toe off to heel strike (i.e., the forward progression of the walking direction).

At toe off, the hip and knee begin to flex. Hip angle motion is produced by a single force or torque acting on the thigh to flex the hip. Inertial forces acting on the shank cause the knee to flex as the hip is accelerated and lifted by the pneumatic muscle. An additional pneumatic muscle contributes to the extension in the knee in preparation for heel strike. Thus, the intended gait motion is realized using only two pneumatic muscles on each limb.

Frame structure 11 as block diagrammed in FIG. 1 is shown in FIG. 2 in more detail as frame structure 58, which, in the embodiment is attached to treadmill 27. The embodiment of FIG. 2 shows pneumatic muscles coupled between left orthotic 26 and right orthotic 28 and frame structure 58. Pneumatic muscle 54 is connected to frame structure 58 at joint 60. Pneumatic muscle 54 is seen as contracted and shorter, therein working to pull the body's left leg forward. Pneumatic muscle 56 is connected to frame structure 58 at joint 62. In contrast, pneumatic muscle 56 is seen as relaxed and more elongated, allowing the right leg to move backward. At approximately the body's ankle axis of rotation, pneumatic muscles 50 and 52 are seen, coupled by universal joint 44 to the left orthotic and coupled by universal joint 48 to the right orthotic. Pneumatic muscle 50 is seen as contracted and shorter, working to pull the body's left leg forward. Again in contrast, pneumatic muscle 52 is seen as relaxed and more elongated.

In the present embodiment, the location of attachments of the pneumatic muscles to the orthotic at universal joints 42, 44, 46 and 48 reflect a consideration of the positions of the hands of physical therapists during manually assisted repetitive motion therapy. Typically, physical therapists place one hand at the knee and another at the ankle. At toe off, physical therapists lift at the knee to flex the hip and push at the ankle to extend the knee.

One embodiment may feature joints 60 and 62 connected to a crossbar that is affixed to frame structure 58. Joints 60 and 62 could be adjusted horizontally across the crossbar to compensate for the stance width of a body.

Turning again to FIG. 2, connectors for an air hosing 64 and 66 are seen in close proximity to joints 60 and 62. Connector 64 couples a compressed air hosing to pneumatic muscle 54. Connector 66 couples a compressed air hosing to pneumatic muscle 56. Similarly, connector 68 couples a compressed air hosing to pneumatic muscle 50, and connector 70 couples a compressed air hosing to pneumatic muscle 52. A variety of types of connectors can be utilized to couple an air hosing to the respective pneumatic muscle.

In some embodiments such as the one shown in FIG. 2, the ankle joint may have to travel a greater distance than the knee joint. As a result, slack may be created in the lower pneumatic muscle when the upper pneumatic muscle is activated. The present embodiment utilizes a pneumatic muscle in series with a retractable cord which is connected to a winding spool to take up the extra slack. FIG. 2 shows left retractable cord 72 and right retractable cord 74 attached to winding spool 76. Retractable cord 72 and 74 are shown coupled between winding spool 76 and left and right pneumatic muscles 50 and 52, respectively.

Some embodiments may include the use of a locking device to prevent the lower pneumatic muscle from pulling against the retractable cord and lengthening the cord during a period of pneumatic muscle contraction. Such a locking device may be incorporated into winding spool 76 and could include such features as a solenoid that responds to current, torsion spring and lock plunger.

Other embodiments may address the issue of slack, for example, by using a full-length pneumatic muscle and including an additional complex controller such as a variable airflow controller to actuate the lower pneumatic muscles in tandem with the upper muscles.

FIG. 2 shows a control mechanism 78 to control the movement and actuation of the pneumatic muscles and winding spool. Control mechanism 78 may control such parameters as time of activation and length of activation of the pneumatic muscles. Additionally, control mechanism 78 may control the delay between upper and lower pneumatic muscles. Control mechanism 78 could include safety mechanisms to immediately stop the system at the command of a user or upon mechanical failure or medical necessity. In one embodiment, sensors placed on the patient may provide feedback to the control mechanism, which can adjust parameters in real time to match the needs of the individual undergoing therapy to keep the overall therapy consistent. Again, control mechanism 78 may be completely mechanical in nature, or could be comprised of a computer or microprocessor driven system, or a combination of both.

The embodiment of FIG. 2 shows joint 80, which couples support belts 84 and buckling mechanism 82 to frame structure 58. Buckle mechanism 82 and belts 84 serve to function similarly to a car seatbelt in the way that the body is supported. Belts 84 are affixed to harness 86, which surrounds the body and provides physical support.

Another embodiment uses electrical mechanisms in conjunction with adjustable linkages. The embodiment may include an electric motor connected to a retractable cord that is coupled to an orthotic. The electrical motor actuates an adjustable linkage to simulate the contraction of human muscle. In one embodiment, the motor can work to bring a part of the body forwards or upwards. A separate motor then actuates adjustable linkages to pull the part of the body to its original position. The electric motors and actuators are controlled by a control mechanism that adjusts and controls such parameters as motor power and duration. Again, such a system can repeat to simulate repetitive muscle movement and stimulate recovery.

An electrical system using an electric motor coupled to adjustable linkages could allow very accurate positioning and velocity control in specialized therapy settings. In addition, electrical mechanisms could be made relatively silent and are relatively inexpensive.

Another embodiment uses hydraulic mechanisms to actuate the adjustable linkages. Hydraulic actuators work to move the adjustable linkages forwards and to return them to the previous state. Such an embodiment could utilize hydraulic mechanisms as the adjustable linkage as well. Such a system could be designed to be strong, have essentially zero compressibility, and excellent power to weight ratio. A connected control mechanism controls such parameters as hydraulic motion and duration of motion.

Another embodiment utilizes a spring mechanism in conjunction with the adjustable linkages. The spring mechanism could serve as the adjustable linkages, or could serve as actuators to work to move the adjustable linkages. Like previous embodiments, the spring mechanism expands or contracts and imparts corresponding movement in the orthotic. The spring mechanism is controlled by a connected control mechanism that controls such parameters as spring motion and spring duration.

Figure 3:
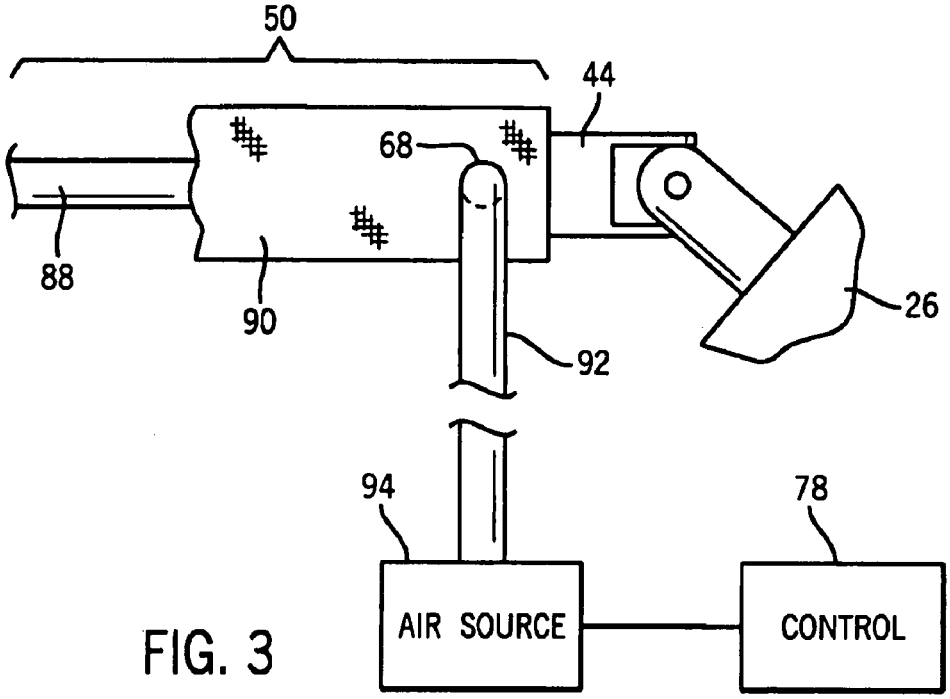
FIG. 3 illustrates a blowup diagram of a pneumatic muscle, its attachment to the orthotic, air source and control mechanism.

Turning to FIG. 3, an exploded view of pneumatic muscle 50 is shown. The knee region of orthotic 26 is shown, coupled with universal joint 44 to pneumatic muscle 50. Air hosing connector 68 is shown in more detail, as are the components of the pneumatic muscle: rubber bladder 88 and braided mesh 90 that covers rubber bladder 88.

Air hosing 92 is seen attached to hosing connector 68. Air source 94 is seen connected to the other end of hosing 92, which provides the compressed air to expand rubber bladder 88 and contract pneumatic muscle 50.

Control mechanism 78 is again shown connected to air source 94. Control mechanism 78 may control such parameters as air pressure, duration of contraction and delays as they relate specifically to air source 94.

Figure 4:
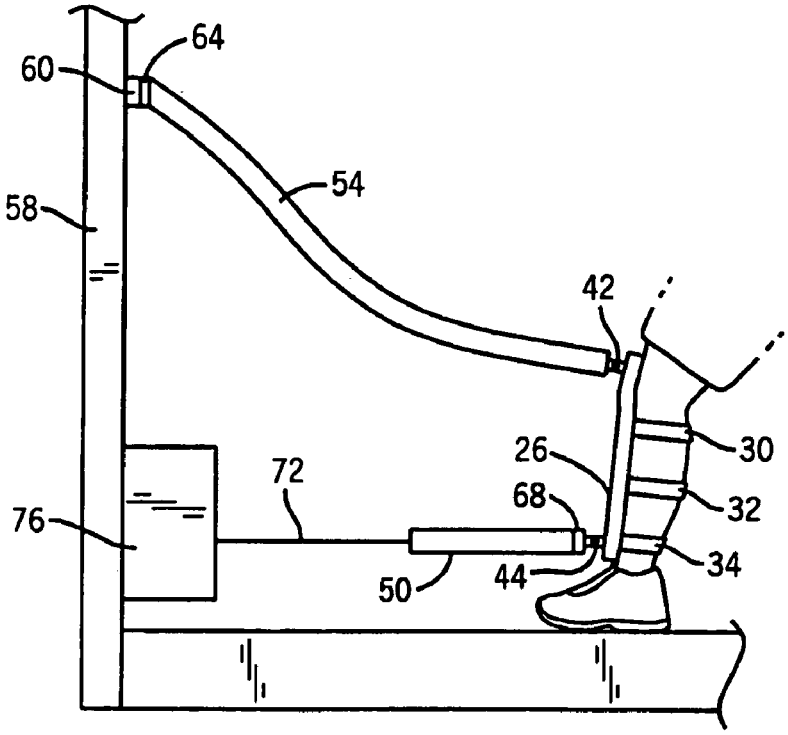
FIG. 4. illustrates a close up view of the configuration of pneumatic muscles, winding spool and retractable cord, and their attachment to the orthotic and part of a body.

Turning to FIG. 4, a detailed view of the configuration of the pneumatic muscles connected to the left leg is shown. Orthotic 26 is again seen on the left leg, connected to the leg by Velcro straps 30, 32 and 34. At approximately the ankle axis of rotation, orthotic 26 is connected to pneumatic muscle 50 by universal joint 44. Similarly, at approximately just above the knee axis of rotation, orthotic 26 is connected to pneumatic muscle 54 by universal joint 42. Connector for air hosing 64 is again seen attached to pneumatic muscle 54, and connector for air hosing 68 is seen attached to pneumatic muscle 50. Frame structure 58 is partially seen, providing structural support for joint 60 where upper pneumatic muscle 54 is attached. In this embodiment, frame structure 58 also provides structural support for winding spool 76 with retractable cord 72 which attaches to lower pneumatic muscle 50.

Figure 5:
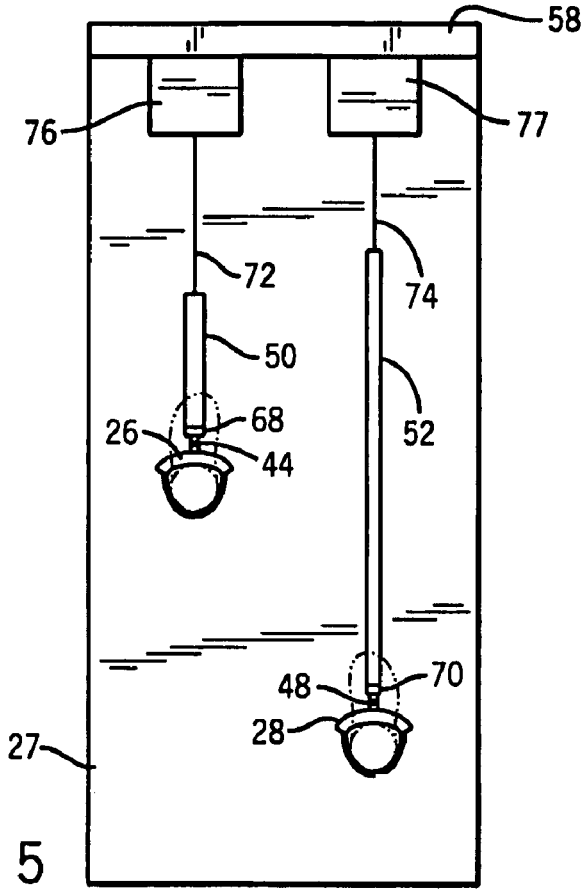
FIG. 5 illustrates a top view of the configuration of lower pneumatic muscles as attached to the orthotic, winding spool and retractable cord, treadmill and frame structure.

Turning to FIG. 5, a top view of the configuration of the lower pneumatic muscles is seen. In this embodiment, treadmill 27 is shown. Orthotics 26 and 28 are attached to the lower left and right legs, respectively. Lower left pneumatic muscle 50 is coupled to orthotic 26 at universal joint 44. Pneumatic muscle 50 is seen as contracted and shorter, pulling the left leg forward. Pneumatic muscle 52 is seen as relaxed and more elongated, allowing the right leg to travel backwards. Lower right pneumatic muscle 52 is coupled to orthotic 28 at universal joint 48. Frame structure 58 provides structural support for and attaches left winding spool 76 with retractable cord 72.

Frame structure 58 also provides structural support for and attaches right winding spool 77 with retractable cord 74. Retractable cord 72 is attached to lower left pneumatic muscle 50. Retractable cord 74 is attached to lower right pneumatic muscle 52. Connector for air hosing 68 is seen in close proximity to universal joint 44. Similarly, connector for air hosing 70 is seen in close proximity to universal joint 48.

Figure 6:
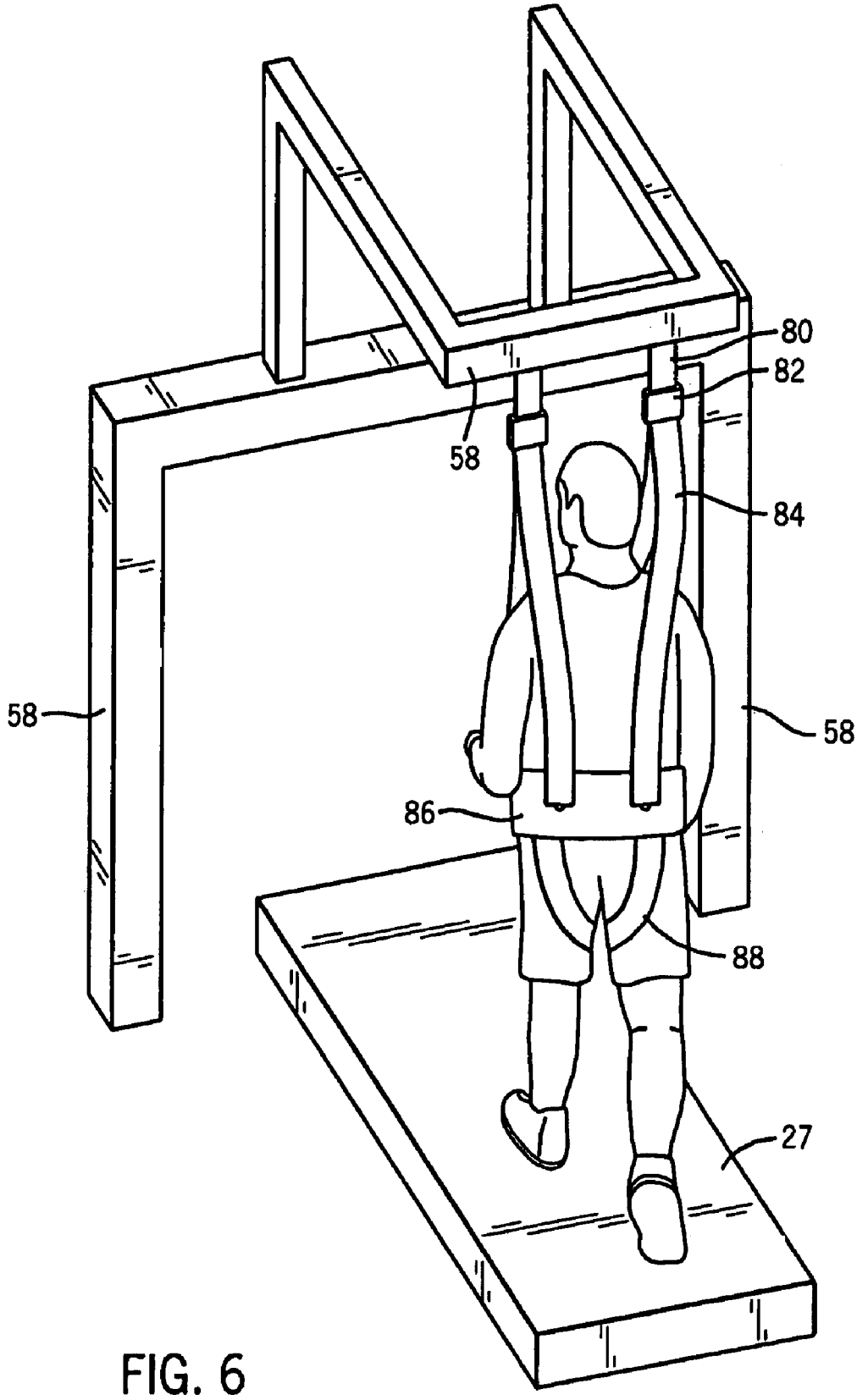
FIG. 6 shows a back view of a subject undergoing repetitive motion therapy and illustrates the configuration of the body and attachments to the frame structure and relationship to a treadmill.

Turning to FIG. 6, a back view of an embodiment of a body undergoing repetitive motion therapy is shown. FIG. 6 is intended to depict specifically how the body is supported by frame structure 58. As such, for purposes of this illustration the adjustable linkages and associated orthotics, joints, connectors with air hosing, winding spools and retractable cords that are depicted in such embodiments as FIG. 2 are not shown. In this embodiment treadmill 27 is partially shown. Frame structure 58 is seen on the left and right side of treadmill 27. In this embodiment, frame structure 58 may be free standing or it may be physically connected to treadmill 27 to provide additional structural support. Additionally, frame structure 58 is seen above the head, where joints 80, on the left and right side, couple support belts 84, also found on either side as well as front and back and buckling mechanisms 82 on each side to frame structure 58. The body is held in place by harness 86, which is connected to support belts 84 on the left and right side, in front and in back. Harness 86 is further supported by straps 88 which connect to the lower left and right sides, front and back, of harness 86.

One embodiment may feature joints 80 as adjustable in width to match the stance width of the body in therapy.

Figure 7:
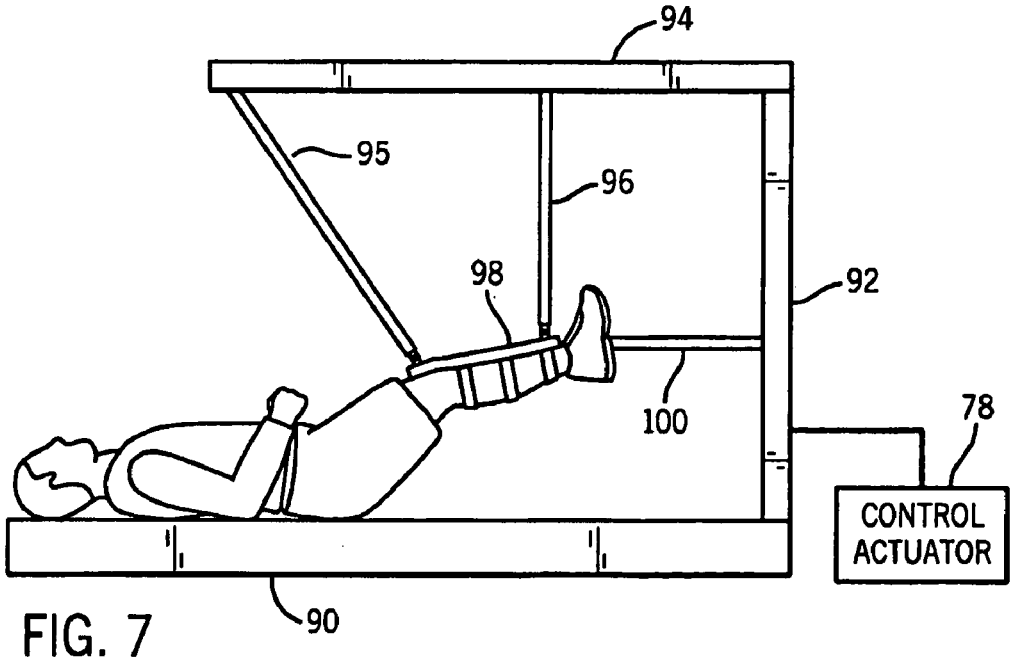
FIG. 7 illustrates an embodiment of the apparatus with frame structure adapted to secure to a bed frame for in-home repetitive motion therapy.

Turning to FIG. 7, another embodiment showing a body undergoing repetitive motion therapy is shown. The body is resting in a reclined position on table 90 which is configured for therapy. Control actuator 78 connects to table 90 to control and actuate the adjustable linkages. Table 90 is connected to vertical frame structure 92 and horizontal frame structure 94. Adjustable linkages 95 and 96 and coupled to frame structure 94 and orthotic 98, which in the embodiment, is attached to the body's right leg. Adjustable linkages 95 and 96 actuate, contract and shorten, working to bring the leg upwards. Adjustable linkage 100 is coupled between the shoe worn on the body's foot and frame structure 92. Adjustable linkage 100 also actuates, contracts and shortens, working to extend the leg. Again, a variety of configurations of connections between the frame structure, the adjustable linkages, and the part of the body can be made in order to facilitate effective repetitive motion that replicates manually assisted therapy beyond what is depicted in this embodiment.

Control mechanism 78 works to actuate the adjustable linkages in a manner that causes the linkages to contract and relax in a manner similar to the normal physiological movement of the part of the body undergoing therapy.

Another embodiment may feature the body in a reclined position similar to the diagram in FIG. 7, where adjustable linkages are coupled to a part of a body, and actuate to bring a part of a body upwards. The embodiment may then rely on gravity to bring the part of the body to its resting or relaxed state.

Another embodiment may feature frame structure 58 modified to fit on a bed frame. Adjustable linkages may couple an orthotic attached to a part of the body to the modified frame structure. Again, the apparatus could work to systematically contract and relax the adjustable linkages in a manner resembling normal physiological movement. In this way, the apparatus may be used in a home setting to stimulate repetitive motion of targeted parts of the body and in effect, assist in an in-home exercise therapy setting.

While one or more embodiments of the present invention have been illustrated in detail, the skilled artisan will appreciate that modifications and adaptations to those embodiments may be made without departing from the scope of the present invention as set forth in the following claims.

What is claimed is:

1. An apparatus for repetitive motion therapy, comprising:
a frame structure;
an orthotic adapted for securing to a part of a body;
an adjustable linkage coupled between the frame structure and the orthotic, wherein the adjustable linkage includes a pneumatic muscle for moving the orthotic; and
a control mechanism for controlling the adjustable linkage.

2. The apparatus of claim 1, wherein the pneumatic muscle contracts to impart movement to the orthotic.

3. The apparatus of claim 1, further including a winding spool and retractable cord attached to the pneumatic muscle.

4. The apparatus of claim 1, wherein the adjustable linkage comprises a spring mechanism to impart movement to the orthotic.

5. The apparatus of claim 1, wherein the adjustable linkage further includes an electric mechanism to impart movement to the orthotic.

6. The apparatus of claim 5, wherein the electric mechanism further includes an electric motor to impart movement to the orthotic.

7. The apparatus of claim 1, wherein the adjustable linkage further includes a hydraulic mechanism to impart movement to the orthotic.

8. The apparatus of claim 7, wherein the hydraulic mechanism further includes a hydraulic actuator to impart movement to the adjustable linkage.

9. The apparatus of claim 1, further including a treadmill to impart motion to the part of the body.

10. The apparatus of claim 1, further including a bed frame that is adapted for securing to the frame structure.

11. The apparatus of claim 1, wherein the orthotic includes:
a covering for connecting to the adjustable linkage;
a strap coupled between the covering and the part of the body; and
a layer of padding disposed over a surface of the covering.

12. The apparatus of claim 1, wherein the orthotic is adapted for securing to a leg of the body.

13. The apparatus of claim 1, wherein the control mechanism further includes a variable airflow controller to control the movement of the orthotic.

14. The apparatus of claim 1, wherein the control mechanism receives and synthesizes data from a feedback sensor disposed on the body.

15. A method for providing repetitive motion therapy, comprising:
securing an orthotic to a portion of a body, wherein the orthotic is attached to an adjustable linkage;
actuating the adjustable linkage by way of a pneumatic muscle to cause repetitive motion of the orthotic which imparts corresponding movement to the portion of the body;
securing the pneumatic muscle to a winding spool and retractable cord; and
actuating the winding spool and retractable cord.

16. The method of claim 15, wherein actuating the adjustable linkage further includes using a control mechanism to control the adjustable linkage.

17. The method of claim 15, wherein actuating the adjustable linkage includes using a spring mechanism to impart movement to the orthotic.

18. The method of claim 15, wherein actuating the adjustable linkage includes using an electric mechanism to impart movement to the orthotic.

19. The method of claim 18, wherein using an electric mechanism further includes:
using an electric motor connected to the adjustable linkage; and
actuating the electric motor to impart movement to the adjustable linkage.

20. The method of claim 15, wherein actuating the adjustable linkage includes using a hydraulic mechanism to impart movement to the adjustable linkage.

21. The method of claim 20, wherein using a hydraulic mechanism further includes actuating a hydraulic mechanism to impart movement to the orthotic.

22. The method of claim 15, further including coupling the frame structure to a treadmill to impart motion to the part of the body.

23. The method of claim 15, further including adapting and securing the frame structure to a bed frame.

24. The method of claim 15, further including constructing an orthotic thatincludes a layer of padding, a strap and a covering.

25. The method of claim 15, further including adapting the orthotic for securing to a leg of the body.

26. The method of claim 15, further including controlling the apparatus using a variable airflow controller for controlling movement in the adjustable linkage.

27. The method of claim 15, further including receiving and synthesizing data from a feedback sensor disposed on the body.

28. A method of making a therapy apparatus, comprising:
providing a frame assembly;
providing an orthotic adapted for securing to a portion of a body; and
providing an adjustable linkage for coupling between the frame assembly and the orthotic such that the adjustable linkage causes repetitive motion of the orthotic which imparts corresponding movement of the portion of the body, the adjustable linkage, including a pneumatic muscle secured to a winding spool and retractable cord.

29. The method of claim 28, further including providing a control mechanism for controlling the adjustable linkages.

30. The method of claim 28, wherein providing an adjustable linkage includes providing a spring mechanism to impart movement to the orthotic.

31. The method of claim 28, wherein providing the adjustable linkage includes providing an electric mechanism to impart movement to the orthotic.

32. The method of claim 31, wherein providing an electric mechanism further includes providing an electric motor to impart movement to the adjustable linkage.

33. The method of claim 28, wherein providing an adjustable linkage further includes providing a hydraulic mechanism that imparts movement to the adjustable linkage.

34. The method of claim 28, further including providing a treadmill in order to impart motion to the part of the body.

35. The method of claim 28, further including providing means for the frame structure to secure to a bed frame.

36. The method of claim 28, further including providing an orthotic that is constructed of a layer of padding, a strap and a covering.

37. The method of claim 28, wherein providing an orthotic further includes providing an orthotic which is adapted for securing to a leg of the body.

38. The method of claim 28, further including providing a control mechanism for controlling the apparatus using a variable airflow controller.

39. The method of claim 28, further including providing means to receive and synthesize data from a feedback sensor disposed on the body.

40. A repetitive motion therapy apparatus, comprising:

a frame structure;

an orthotic adapted for securing to a part of a body;

a pneumatic muscle coupled between the frame structure and orthotic for moving the orthotic; and a control mechanism for controlling the pneumatic muscle.

41. The repetitive motion therapy apparatus of claim 40, wherein the pneumatic muscle contracts to impart movement to the orthotic.

42. The repetitive motion therapy apparatus of claim 40, further including a winding spool and retractable cord attached to the pneumatic muscle.

43. The repetitive motion therapy apparatus of claim 40, wherein the pneumatic muscle is operated by an electric mechanism, hydraulic mechanism, or spring mechanism to impart movement to the orthotic.

44. The repetitive motion therapy apparatus of claim 40, wherein the control mechanism further includes a variable airflow controller to control the movement of the orthotic.

45. The repetitivemotion therapy apparatus of claim 40, further including a feedback sensor disposed on the body for providing data to the control mechanism.

46. A method of making a therapy apparatus, comprising:

providing a frame assembly;

providing an orthotic adapted for securing to a portion of a body; and providing a pneumatic muscle coupled between the frame assembly and orthotic such that the pneumatic muscle causes repetitive motion of the orthotic which imparts corresponding movement of the portion of the body.

47. The method of claim 46, wherein the pneumatic muscle uses an electrical mechanism, hydraulic mechanism, or spring mechanism to impart movement to the orthotic.

48. The method of claim 46, further including providing a control mechanism for controlling the apparatus using a variable airflow controller.

49. The method of claim 46, further including synthesizing data from a feedback sensor disposed on the body.

* * * * *

UNITED STATES PATENT AND TRADEMARK OFFICE

CERTIFICATE OF CORRECTION

PATENT NO. : 7,331,906 B2
APPLICATION NO. : 10/971867
DATED : February 19, 2008
INVENTOR(S) : Jiping He and Ryan B. Knight It is certified that error appears in the above-identified patent and that said Letters Patent is hereby corrected as shown below:

Column 10, line 19, insert space between “that” and “includes”.

Column 12, line 1, insert space between “repetitive” and “motion”.

Signed and Sealed this

Third Day of June, 2008

JON W. DUDAS
*Director of the United States Patent and Trademark Office*